United States Patent [19]

Taubner et al.

[11] Patent Number: 4,639,637

[45] Date of Patent: Jan. 27, 1987

[54] ARC DISCHARGE LAMP HAVING IMPROVED LUMEN MAINTENANCE

[75] Inventors: Fred R. Taubner; Joseph A. Roy, both of Danvers, Mass.

[73] Assignee: GTE Products Corporation, Stamford, Conn.

[21] Appl. No.: 228,865

[22] Filed: Jan. 27, 1981

[51] Int. Cl.[4] ..... H01J 31/00; H01J 31/26

[52] U.S. Cl. ..... 313/489

[58] Field of Search ..... 313/489

[56] References Cited

U.S. PATENT DOCUMENTS

| | | | |
|---|---|---|---|
| 3,886,396 | 5/1975 | Hammer et al. | 313/486 |
| 4,058,639 | 11/1977 | Schreurs | 427/67 |
| 4,079,288 | 3/1978 | Maloney et al. | 313/489 |

*Primary Examiner*—William L. Sikes
*Assistant Examiner*—Robert E. Wise
*Attorney, Agent, or Firm*—William H. McNeill; Carlo S. Bessone

[57] ABSTRACT

Lumen maintenance of fluorescent lamps is improved by overcoating the phosphor layer with a coating of submicron size alumina having a weight greater than 160 micrograms per square centimeter.

5 Claims, 2 Drawing Figures

ARC DISCHARGE LAMP HAVING IMPROVED LUMEN MAINTENANCE

TECHNICAL FIELD

This invention relates to arc discharge lamps which utilize phosphors within the discharge chamber and particularly to such lamps having improved lumen maintenance.

BACKGROUND ART

Arc discharge lamps such as fluorescent lamps which employ a phosphor within a discharge chamber, which chamber also contains an ionizable medium together with mercury vapor, suffer from a gradually decreasing light output as they age. Various factors contribute to the drop-off in light output during operation, and some of these may be caused by deposits of impurities from the cathode; the formation of various compounds of mercury; changes in the phosphor itself; and changes in the glass envelope, particularly where it may be subject to ultraviolet radiation. The ability of such lamps to resist drop-off in light output is generally termed lumen maintenance, and it is measured as the ratio of light output at a given life span compared to an initial light output and expressed as a percentage. Since the light output of a new lamp is apt to vary considerably until it has been in operation for some time, it is usual to start lumen maintenance measurements from some time other than time zero.

While decreasing light output with time is an occurrence for all fluorescent lamps, it is much more of a problem for high output and very high output lamps than it is for normally loaded lamps.

Although all of the conditions enumerated above can be present to a greater or lesser degree in acting to reduce light output, it is presently believed that the formation of mercury compounds, particularly on the surface of the phosphor, is one of the primary factors.

It is believed that these mercury compounds form an ultraviolet radiation absorbing film which prevents the phosphor from receiving sufficient exciting radiation from the mercury discharge to achieve maximum light output.

Various uses of alumina within such lamps have been proposed to alleviate this condition. For example, U.S. Pat. Nos. 4,079,288 and 4,058,639, as well as others, discuss employing a layer of alumina on the interior of the bulb wall and applying phosphor thereof.

U.S. Pat. No. 3,886,396 teaches the application of a thin, porous, discontinuous layer of alumina being applied over the phoshor layer. While all of these techniques provide some benefit, it is believed that further increases in lumen maintenance are desirable.

DISCLOSURE OF INVENTION

Accordingly, it is an object of this invention to provide a lamp having improved lumen maintenance.

It is another object of this invention to provide a method for making shch a lamp.

These objects are accomplished in one aspect of the invention, by the provision of an arc discharge lamp having a light emitting envelope containing an ionizable medium which includes mercury vapor and having electrodes sealed in the ends thereof. The lamp has a layer of phosphor on the interior surface of the envelope. A layer of submicron size alumina overlies the layer of phosphor, the weight of the alumina being greater than 160 micrograms per square centimeter.

It has been discovered that relatively heavy amounts of alumina greatly increase the lumen maintenance of lamps of the fluorescent variety, maintenance figures of better than 90% being achieved with many types of lamps.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
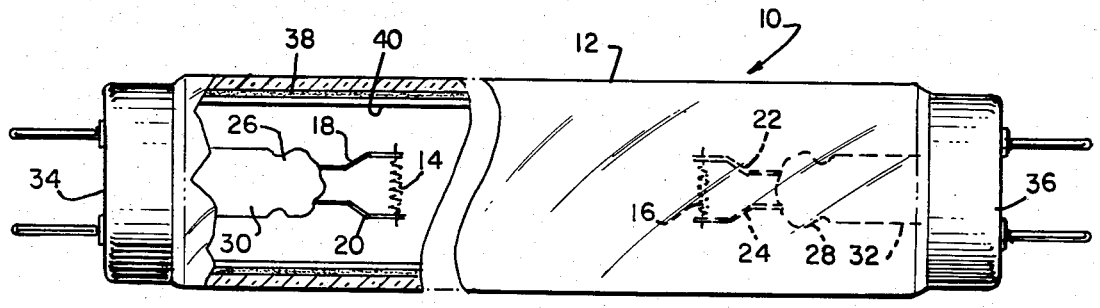
FIG. 1 is a view of a fluorescent lamp, partially in section, illustrating the invention.
Figure 2:
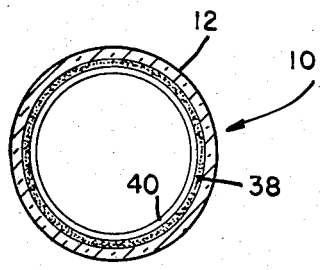
FIG. 2 is a cross-sectional view of the lamp of FIG. 1.

Referring now to the drawings with greater particularity, there is shown in FIG. 1 an arc discharge lamp 10, of the fluorescent type. The lamp 10 is comprised of an elongated glass tube 12 of circular cross-section. It has the usual electrodes 14 and 16 at each end supported by lead-in wires 18, 20; and 22, 24 respectively, which extend through glass presses 26, 28 in mount stems 30, 32, to the contacts in bases 34, 36, affixed to the ends of the lamp.

The sealed tube is filled with an inert gas such as argon or a mixture of argon and neon at a low pressure, for example 2 torr, and a small quantity of mercury, at least enough to provide a low vapor pressure of about six microns during operation.

The interior of tube 12 is coated with a layer of phosphor 38 such, for example, as a calcium halophosphate activated by antimony and manganese.

A phophor coating suspension was prepared by dispersing the phosphor particles in a water base system employing polyethylene oxide as the binder with water as the solvent.

The phosphor suspension was applied in the usual manner of causing the suspension to flow down the inner surface of the bulb and allowing the water to evaporate leaving the binder and phosphor particles adhered to the bulb wall. The phosphor coated bulbs were then baked in a lehr to burn off the organic components, the phosphor particles remaining on the bulb wall.

The phosphor layer 38 is then overcoated with a relatively heavy layer 40 of submicron size alumina, such as Aluminum Oxide C, available from Degussa, Inc. This material has a particle size range of 0.01 to 0.04 microns and a surface area of about 100 square meters per gram. As used herein, the term "relatively heavy" layer means a weight of alumina greater than 160 micrograms per square centimeter.

The alumina layer 40 also is applied from a suspension; the suspension comprising alumina particles in a water-base vehicle of a binder of polyethylene oxide and hydroxyethyl methyl cellulose dissolved in water. The alumina suspension of various concentrations were then applied by allowing the coatings to flow down over the phosphor particles until the excess alumina coating drained from the bottom of the bulb indicating that the coverage of the phosphor was complete. The alumina coated bulbs were again baked to remove the organic components of the binder and were then processed into fluorescent lamps by conventional lamp manufacturing techniques.

Control lamps were fabricated by identical techniques but had no alumina overcoat.

A number of different fluorescent lamp types were evaluated at various alumina overcoat concentrations, together with uncoated controls, and the results are summarized in Tables I–IV. In all of these Tables the lumen maintenance is calculated as the ratio of light output at the ending hour relative to the light output at 100 hours. The comparisons have been made on the basis of the 100 hour starting point because of the very rapid dro-off during initial operations which would distort the maintenance figures.

and in most cases surpassing, 90%, are achieved after up to 6000 hours of operation.

The tests were run by photometering the lamps for light output in a standard photometric sphere, both initially and at the stated times.

Thus, it will be seen that improved lamps are produced by employing the relatively heavy overcoat of alumina. Substituting organic solvent binder coatings such as nitrocellulose binder with butyl acetate solvent for the phosphor and ethyl cellulose binder with xylol solvent for the alumina produced similar results. Additionally, the same beneficial results were obtained regardless of whether the phosphor binder was removed prior to the application of the alumina or a single bake was employed.

TABLE I

| | LAMP TYPE: 58T8/ES COOL WHITE HALOPHOSPHATE | | | | | | | |
|---|---|---|---|---|---|---|---|---|
| Coating | $Al_2O_3$ Weight Micrograms/$CM^2$ | Lumens 100 Hrs. | Lumens 3000 Hrs. | Lumen Maintenance % (100–3000 Hrs.) | Lumens 4000 Hrs. | Lumen Maintenance % (100–4000 Hrs.) | Lumens 6000 Hrs. | Lumen Maintenance % (100–6000 Hrs.) |
| Phosphor Only | 0 | 4,684 | 3,742 | 79.9 | 3,506 | 74.9 | 3,276 | 69.9 |
| Phosphor + $Al_2O_3$ | 61 | 4,717 | 4,001 | 84.8 | 3,857 | 81.8 | 3,616 | 76.7 |
| Phosphor + $Al_2O_3$ | 484 | 4,064 | 3,837 | 94.4 | 3,767 | 92.7 | 3,697 | 91.0 |

TABLE II

| | LAMP TYPE: 58T8/ES WARM WHITE HALOPHOSPHATE | | | |
|---|---|---|---|---|
| Coating | $Al_2O_3$ Weight Micrograms/$CM^2$ | Lumens 100 Hrs. | Lumens 3000 Hrs. | Lumen Maintenance % (100–3000 Hrs.) |
| Phosphor Only | 0 | 4,703 | 3,739 | 79.5 |
| Phosphor + $Al_2O_3$ | 78 | 4,780 | 4,279 | 89.5 |
| Phosphor + $Al_2O_3$ | 162 | 4,731 | 4,318 | 91.3 |
| Phosphor + $Al_2O_3$ | 202 | 4,730 | 4,382 | 92.6 |
| Phosphor + $Al_2O_3$ | 294 | 4,572 | 4,282 | 93.7 |

TABLE III

| | LAMP TYPE: 96T12 H.O. COOL WHITE HALOPHOSPHATE | | | |
|---|---|---|---|---|
| Coating | $Al_2O_3$ Weight Micrograms/$CM^2$ | Lumens 100 Hrs. | Lumens 2000 Hrs. | Lumen Maintenance % (100–2000 Hrs.) |
| Phosphor Only | 0 | 8,971 | 7,908 | 88.2 |
| Phosphor + $Al_2O_3$ | 287 | 8,851 | 8,340 | 94.2 |

TABLE IV

| | LAMP TYPE: 96T12 VHO COOL WHITE HALOPHOSPHATE | | | |
|---|---|---|---|---|
| Coating | $Al_2O_3$ Weight Micrograms/$CM^2$ | Lumens 100 Hrs. | Lumens 2378 Hrs. | Lumen Maintenance % (100–2378 Hrs.) |
| Phosphor Only | 0 | 14,170 | 11,584 | 81.8 |
| Phosphor + $Al_2O_3$ | 333 | 14,894 | 13,277 | 89.1 |

A perusal of the Tables will show that alumina overcoating weights ranging from zero (control) to 484 micrograms per square centimeter were employed. As might be expected from the disclosure of U.S. Pat. No. 3,886,398, the relatively heavy coating weights produced lamps whose initial brightness was less than that of the control. (The exception in Table IV is felt to be an aberration.) Totally unexpected, however, is the fact that, after 2000 to 6000 hours of operation (depending upon lamp type and coating weight), not only is the maintenance of the relatively heavy coated lamps better than the control, but the actual light output is also greater. Thus, lumen maintenance values approaching, Scanning electron Microscope photographs taken of the coated lamps at 10,000× show the alumina particles covering the surface of the phosphor particles throughout the thickness of the film and penetrating down to the glass surface.

While there have been shown what are at present considered to be preferred embodiments of the invention, it will be apparent to those skilled in the art that various changes and modifications can be made herein without departing from the scope of the invention as defined by the appended claims.

We claim:

1. An arc discharge lamp having a light emitting envelope containing an ionizable medium which includes mercury vapor and having electrodes sealed into the ends thereof; and a layer of phosphor on the interior surface of said envelope, the improvement comprising: a layer of submicron size alumina overlying said layer of phosphor, the weight of said alumina being in the range of about 300 to 500 micrograms per square centimeter.

2. The discharge lamp of claim 1 wherein said discharge lamp is a fluorescent lamp.

3. The discharge lamp of claim 1 wherein said phosphor is a calcium halophosphate.

4. An arc discharge lamp having a light emitting envelope containing an ionizable medium which includes mercury vapor and having electrodes sealed into the ends thereof; and a layer of phosphor on the interior surface of said envelope, the improvement comprising: a layer of submicron size alumina overlying said layer of phosphor, the weight of said alumina being greater than 200 micrograms per square centimeter.

5. The discharge lamp of claim 4 wherein the weight of said alumina is in the range of greater than 200 to about 500 micrograms per square centimeter.

* * * * *